United States Patent [19]

Willing

[11] Patent Number: 4,761,721

[45] Date of Patent: Aug. 2, 1988

[54] REFLECTOR FOR AN OBLONG LIGHT SOURCE

[75] Inventor: Achim Willing, Schlesslitz-Burgellern, Fed. Rep. of Germany

[73] Assignee: Raak Licht B.V., Aalsmeer, Netherlands

[21] Appl. No.: 53,345

[22] Filed: May 22, 1987

[30] Foreign Application Priority Data

May 26, 1986 [NL] Netherlands ..... 8601338

[51] Int. Cl.[4] ..... F21V 7/00

[52] U.S. Cl. ..... 362/348

[58] Field of Search ..... 362/347, 348, 350, 346

[56] References Cited

U.S. PATENT DOCUMENTS

| | | | |
|---|---|---|---|
| 1,841,917 | 1/1932 | Schimpff | 362/348 |
| 3,329,812 | 7/1967 | Harling | 362/223 |
| 3,662,165 | 5/1972 | Osteen et al. | 362/348 |
| 3,705,302 | 12/1972 | Judge et al. | 362/348 |
| 4,347,554 | 8/1982 | Matsushita | 362/348 |
| 4,351,018 | 9/1982 | Fratty | 362/348 |

*Primary Examiner*—Charles J. Myhre
*Assistant Examiner*—David A. Okonsky
*Attorney, Agent, or Firm*—Arnold, White & Durkee

[57] ABSTRACT

A reflector for an oblong light source is disclosed, which includes a conical part (1) to which a curved part (2) connects. The inside of both the conical part and the curved part of the reflector have longitudinal grooves extending longitudinally along the parts. A number of grooves in the curved reflector part (2) are provided with a reflection face (8) which runs parallel to a line passing through the starting point and the finishing point of the groove bottom (6). The reflection face is oriented to face towards the central axis of the reflector.

18 Claims, 2 Drawing Sheets

REFLECTOR FOR AN OBLONG LIGHT SOURCE

BACKGROUND OF THE INVENTION

The invention relates to a reflector for an oblong light source, comprising a conical part to which a curved part connects, said parts being provided on the inside with longitudinal grooves.

Light fittings with downward-directed light beams are used, for example, to direct light from the ceiling onto, say, the floor. Here, reflectors are used to direct the light as well as possible onto the object. For point-shaped light sources, virtually ideal reflector forms can be calculated, because point-shaped light sources do not stand in the way of the light beams reflected by the reflector. In particular, light distributions in which the light intensity increases as the angle relative to the centre line of the reflector increases can be achieved. By means of such light intensity distributions, which are also described as wing-shaped, a light intensity distribution which is as uniform as possible can be obtained on the area to be illuminated, for example the floor.

Oblong lamps, such as compact fluorescent lamps are not point-shaped and therefore have a light-radiating and, conversely also, a light-absorbing surface which is so large compared with the dimensions of the reflector that the lamp constitutes a hindrance for the light rays coming from the reflector. This means that, without additional measures, only light intensity distributions which are at a maximum at or near the reflector centre line can be obtained.

In order to obtain a wing-shaped light distribution, applicants have developed a reflector cap, comprising a conical and a curved part. These parts are provided with longitudinal grooves. Viewed in the cross section of the reflector, the said longitudinal grooves are preferably triangular in shape. In this way, the light rays falling on the walls of the grooves are deflected in such a way that they run along the oblong light source and thus contribute to a wing shaping of the light intensity distribution.

A precise calculation of the light intensity distribution which can be expected is almost impossible due to the multiple reflections, and it would be too inaccurate, while the physical conditions have to be idealised. That is why, for the determination of the light intensity distribution produced by the longitudinal grooves or facets, one is dependent on measurements. Depending on the design of the reflector, it always happens that a further correction of the reflector is hardly possible, for example if material had to be added in the equipment for making the reflector in order to achieve the desired shape. Corrections of the curves of the curved part are very difficult to carry out and give rise to high costs. Despite the great difficulty and the costs, a uniform lighting intensity is not achieved. Moreover, the grooves give rise to a rotationally symmetrical wing-shaped light intensity distribution which means that, in a plane perpendicular to the centre line of the lamp, a light distribution is produced in which the light intensity is less in the centre than outside the centre.

SUMMARY OF THE INVENTION

The object of the invention is to provide a reflector of the type referred to in the preamble, in which the above-mentioned disadvantages and problems are avoided, or the equipment can be adapted in a simple manner.

This object is achieved according to the invention in that a number of grooves in the curved reflector part are provided with a reflection face which runs parallel to the line through the starting point and finishing point of the groove bottom of the curved reflector part and is directed towards the centre line of the reflector.

Through sliding the reflection face parallel more or less towards or away from the centre line of the reflector, a correction can be made in the centre of the area to be lit which is perpendicular to the centre line of the lamp. This correction is to some extent at the expense of the light intensity in the wings.

A further correction is preferably compensated for by the fact that the grooves in the conical reflector part, which are in line with the grooves provided with the reflection faces in the curved reflector part, are provided with a second reflection face which is directed towards the centre line of the reflector and runs from the centre of the first reflection face and to a point of the bottom of the groove in the conical reflector part. The optimum compensation can be achieved by making the second reflection face run more or less in the direction of the starting point of the groove in the curved reflector part.

BRIEF DESCRIPTION OF THE DRAWINGS

The invention will be explained in greater detail below with reference to an embodiment illustrated in the drawings, in which.

DETAILED DESCRIPTION OF A PREFERRED EMBODIMENT

Figure 1:
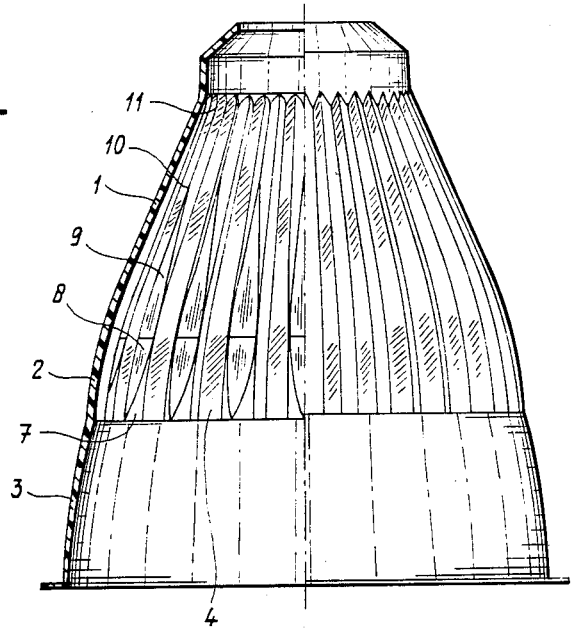
FIG. 1 shows a cross section along the line I—I of the reflector according to FIG. 2.
Figure 3:
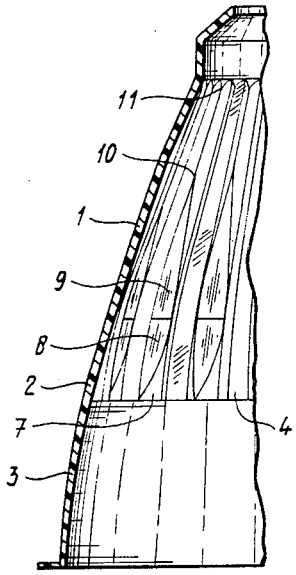
FIG. 3 shows a cross section along the line III—III of FIG. 2.
Figure 2:
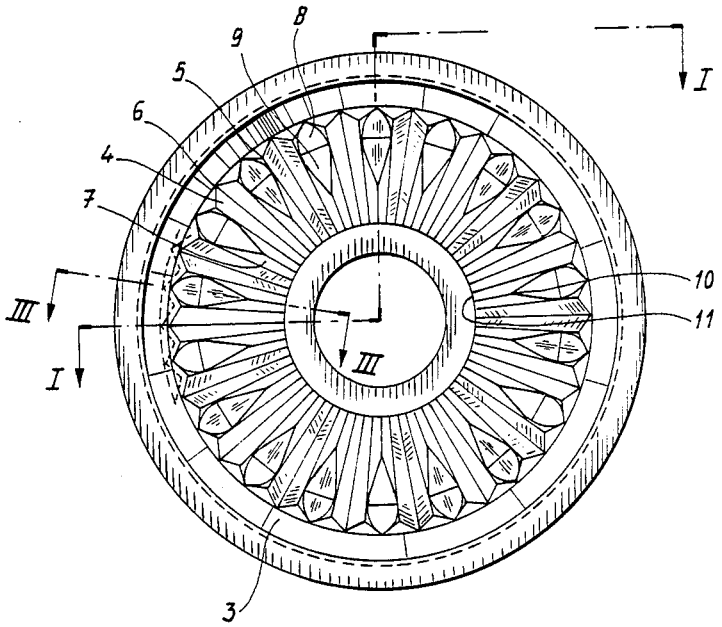
FIG. 2 shows a bottom view of the reflector according to the invention.

The reflector cap according to FIG. 1 comprises a conical part 1 and a curved part 2. The reflector cap also has a part 3 which contributes to the light intensity in the wings, but in particular serves as a dazzle screen. The oblong lamp (not shown) must be on the centre line of the reflector cap, while the lower end of the lamp is at the level of the transition between the curved part 2 and the anti-dazzle part 3 of the reflector cap. On account of the fitting of the lamp, the other end of the lamp will be below the top end of the reflector cap. This fitting and the fastening thereof are not shown, again for the sake of clarity. The inside of the curved part 2 and the conical part 1 is provided with grooves 4. These grooves extend at least over the length of the lamp. The shape of the grooves is most clearly seen in FIG. 2. The grooves preferably run in zigzag fashion with peaks 5 and troughs 6. A number of grooves 7 are provided with a first reflection face 8 and a second reflection face 9. The profile of the faces can be seen most clearly in FIG. 3. The first reflection face 8 is directed towards the centre line of the reflector and runs parallel to the imaginary line through the starting and finishing point of the curved groove bottom. Through parallel sliding of this face, a correction of the light intensity in the centre of the area to be lit can be made. This correction is accompanied by a slight reduction in light intensity in the wings, in other words, those light rays which form a greater angle with the centre line of the reflector. A further correction can be achieved again by the second reflection face 9, which is also directed towards the centre line of the reflector, and which intersects the first reflection face 8 in the centre thereof and runs from the centre through to a point lying between the said intersection line with the first reflection face 8 and a point 10 of the bottom of the groove. The above effect can be further increased by setting the angle of this face relative to the centre line of the reflector. In some embodiments it has been found that the said point must coincide with the starting point 11 of the groove. One can determine experimentally how many and/or which grooves must be provided with the said reflection faces 8 and 9. In the embodiment shown with the predetermined dimensions and shape, it was found that an optimum was achieved if the reflection faces are used in every other groove.

In order to permit determination of the optimum experimentally in a simple manner, the procedure is as follows.

The angle of the groove is experimentally determined in such a way that a strong wing shaping of the light intensity distribution occurs. Thereafter, through filling up of the grooves and through selection of the place and degree of filling-up of the grooves, the optimum is sought with regard to as low losses as possible and the sort of influence on the light intensity distribution. When the optimum has been found, a correction to the equipment can be made, with the wall thickness of the reflector at the reflection faces 8 and 9 being equal to that of the remaining part of the reflector. The perpendicular of the reflection faces or tangential faces 8 and that of the second reflection faces 9 should preferably be in the same plane as the reflector normal.

It was found that a uniform light intensity distribution on a face perpendicular to the centre line of the reflector can be achieved with improvement of the original output.

I claim:

1. A reflector for an oblong light source, comprising:

a conical reflector part, the conical part having an inside;

a curved reflector part, the curved part being connected with the conical part, the curved part having an inside, the curved part being curved around a central axis of the reflector; and, first longitudinal grooves, the first longitudinal grooves being formed on the inside of the curved part, the first grooves having a groove bottom extending longitudinally from a starting point to a finishing point;

second longitudinal grooves, the second longitudinal grooves being formed on the inside of the conical part; and, a reflection face, the reflection face being provided in at least one of said first grooves in the curved part, the reflection face being formed parallel to a line passing through the starting point and the finishing point of the first groove, the reflection face being oriented to face towards the central axis of the reflector.

2. The reflector according to claim 1, wherein:

the bottoms of the first longitudinal grooves are aligned with the bottoms of the corresponding second longitudinal grooves.

3. The reflector according to claim 1, wherein:

the reflection face of said first groove is substantially planar.

4. The reflector according to claim 3, wherein:

the reflection face of said second groove is substantially planar.

5. A reflector according to claim 1, wherein:

the second longitudinal grooves in the conical part being in line with the first grooves in the curved part, said grooves having a bottom; and, a second reflection face being formed in at least one of said second grooves in the conical part, the second reflection face being oriented to face towards the central axis of the reflector, the second reflection face intersecting at an inner most point with the reflection face of said first groove.

6. The reflector according to claim 5, wherein:

said second longitudinal grooves, when viewed in a plane transverse to the direction of the grooves, are substantially V-shaped.

7. The reflector according to claim 5, wherein:

said second longitudinal grooves have side walls which join at the bottom of the groove to form a substantially V-shaped groove, the reflection face of said second groove bridging the side walls of said groove over a portion of the length of the groove.

8. The reflector according to claim 7, further comprising:

a dazzle screen, the dazzle screen being connected to the curved reflector part at a location remote from the location of the conical part.

9. The reflector according to claim 1, wherein:

said first longitudinal grooves, when viewed in a plane transverse to the direction of the grooves, are substantially V-shaped.

10. The reflector according to claim 9, wherein:

the reflection face of said first groove is substantially planar.

11. The reflector according to claim 9, wherein:

said second longitudinal grooves, when viewed in a plane transverse to the direction of the grooves, are substantially V-shaped.

12. The reflector according to claim 11, wherein:

the reflection face of said second groove is substantially planar.

13. The reflector according to claim 1, wherein:

said first longitudinal grooves having side walls which join at the bottom of the groove to form a substantially V-shaped groove, the reflection face of said first groove bridging the side walls of said groove over a portion of the length of the groove.

14. The reflector according to claim 13, wherein:

the reflection face of said first groove is substantially planar.

15. The reflector according to claim 13, wherein:

said second longitudinal grooves have side walls which join at the bottom of the groove to form a substantially V-shaped groove, the reflection face of said second groove bridging the side walls of said groove over a portion of the length of the groove.

16. The reflector according to claim 15, wherein:

the reflection face of said second groove is substantially planar.

17. The reflector according to claim 16, wherein:

the bottoms of the first longitudinal grooves are aligned with the bottoms of the corresponding second longitudinal grooves.

18. The reflector according to claim 17, further comprising:

a dazzle screen, the dazzle screen being connected to the curved reflector part at a location remote from the location of the conical part.

* * * * *